US008495955B1

(12) United States Patent
Zimmer

(10) Patent No.: US 8,495,955 B1
(45) Date of Patent: Jul. 30, 2013

(54) TREE LIMB BUNDLING TOOL

(76) Inventor: Dennis L. Zimmer, Surprise, AZ (US)

( * ) Notice: Subject to any disclaimer, the term of this patent is extended or adjusted under 35 U.S.C. 154(b) by 0 days.

(21) Appl. No.: 13/352,677

(22) Filed: Jan. 18, 2012

Related U.S. Application Data

(60) Provisional application No. 61/434,121, filed on Jan. 19, 2011.

(51) Int. Cl.
*B65B 13/20* (2006.01)

(52) U.S. Cl.
USPC ..... 100/3; 100/8; 100/34

(58) Field of Classification Search
USPC ..... 100/3, 8, 34; 144/192; 53/592
See application file for complete search history.

(56) References Cited

U.S. PATENT DOCUMENTS

| | | | | | |
|---|---|---|---|---|---|
| 944,929 | A | * | 12/1909 | Westwood | 100/34 |
| 2,418,550 | A | * | 4/1947 | Edwards | 100/3 |
| 2,575,048 | A | * | 11/1951 | Dankert | 100/219 |
| 3,171,347 | A | * | 3/1965 | Elrod | 100/1 |
| 3,567,150 | A | | 3/1971 | Nelson | |
| 3,939,762 | A | * | 2/1976 | Smitherman et al. | 100/4 |
| 4,173,061 | A | * | 11/1979 | Shimizu et al. | 29/403.2 |
| 4,269,242 | A | | 5/1981 | Smith et al. | |
| 4,495,862 | A | | 1/1985 | Davis | |
| 5,072,576 | A | | 12/1991 | Evans | |
| 5,289,765 | A | | 3/1994 | Gray | |
| 5,586,493 | A | * | 12/1996 | McEntee | 100/34 |
| 5,819,642 | A | | 10/1998 | Stuchl | |

* cited by examiner

*Primary Examiner* — Jimmy T Nguyen
(74) *Attorney, Agent, or Firm* — Kenneth L Tolar

(57) ABSTRACT

A tree limb bundling tool includes a cylindrical base container having a bottom surface, a continuous, upstanding outer wall and an open top in communication with an interior chamber. A pair of diametrically-opposed notches extend from the open top to an intermediate portion of the wall. The device also includes a compactor having a circular upper surface with a cylindrical shroud depending therefrom. The shroud likewise includes a pair of opposing notches extending from an intermediate portion to a lower edge. Accordingly, a worker compiles limbs and places them within the notches on the base container. The compactor is inserted into the container with the shroud notches substantially aligned with the base container notches. The worker then either sits or kneels on the upper surface of the compactor at which time a tie or string is wrapped about each end of the compressed limbs.

9 Claims, 2 Drawing Sheets

TREE LIMB BUNDLING TOOL

CROSS REFERENCE TO RELATED APPLICATIONS

This application is entitled to the benefit of provisional application No. 61/434,121 filed on Jan. 19, 2011.

BACKGROUND OF THE INVENTION

The present invention relates to a tool for assisting a worker with bundling tree limbs and similar waste without the need for bags or other containers.

DESCRIPTION OF THE PRIOR ART

When a worker trims shrubs or trees, the resulting limbs are placed within a trash bag for disposal. The limbs must often be further trimmed in order to fit within the bag, which is laborious and difficult. Furthermore, because the bags are usually not biodegradable, they occupy valuable landfill space indefinitely. Accordingly, there is currently a need for a device that assists a worker with bundling tree limbs.

A review of the prior art reveals a few devices that are purportedly designed to address the above-described problems. For example, U.S. Pat. No. 5,819,642 issued to Stuchl discloses a branch bundler including an elongated rod having a handle at one end and a skid at an opposing end. A spool of twine is mounted on the rod for tying branches into a bundle.

U.S. Pat. No. 4,495,862 issued to Davis discloses a limb bundler and bag holder including a frame formed of a plurality of pivotal frame members with a twine dispenser mounted thereon.

U.S. Pat. No. 5,289,765 issued to Gray discloses a device for binding and hauling tree trimmings including an elongated member having a handgrip at one end and a cord at an opposing end. A handle is attached to an end of the cord, which is pulled upwardly to tighten the cord around a bundle of tree limbs or similar debris.

U.S. Pat. No. 4,269,242 issued to Smith et al. discloses a combination log cutter, splitter and bundle.

U.S. Pat. No. 3,567,150 issued to Nelson discloses a motorized bundle tightener.

U.S. Pat. No. 5,072,576 issued to Evans discloses a newspaper bundler including a hollow container having a number of cords for encircling a stack of newspapers resting within the container interior.

Each of the tree limb bundlers described above require a user to compact the limbs by wrapping and tightening a cord, which is laborious and inconvenient. The present invention provides an improved tool having a compacting pedestal on which a user first sits or kneels to compress limbs into a smaller bundle prior to tying them with a cord or string.

SUMMARY OF THE INVENTION

The present invention relates to a tree limb bundling tool comprising a cylindrical base container having a bottom surface, a continuous, upstanding outer wall and an open top in communication with an interior chamber. A pair of diametrically-opposed notches extend from the open top to an intermediate portion of the wall. The device also includes a compactor having a circular upper surface with a cylindrical shroud depending therefrom. The shroud likewise includes a pair of opposing notches extending from an intermediate portion to a lower edge. Accordingly, a worker compiles limbs and places them within the notches on the base container. The compactor is inserted into the container with the shroud notches substantially aligned with the base container notches. The worker then either sits or kneels on the upper surface of the compactor at which time a tie or string is wrapped about each end of the compressed limbs allowing them to be quickly and easily discarded.

It is therefore an object of the present invention to provide a tool that eliminates the burden associated with bundling and discarding tree limbs and similar waste.

It is another object of the present invention to provide a tool that assists a worker with bundling tree limbs.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
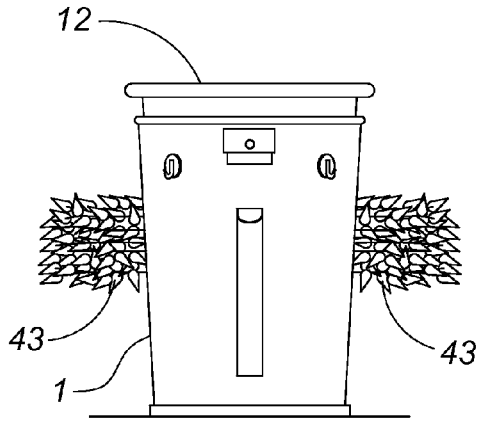
FIG. 2 is a side, plan view of the tool with tree limbs loaded therein.
Figure 1:
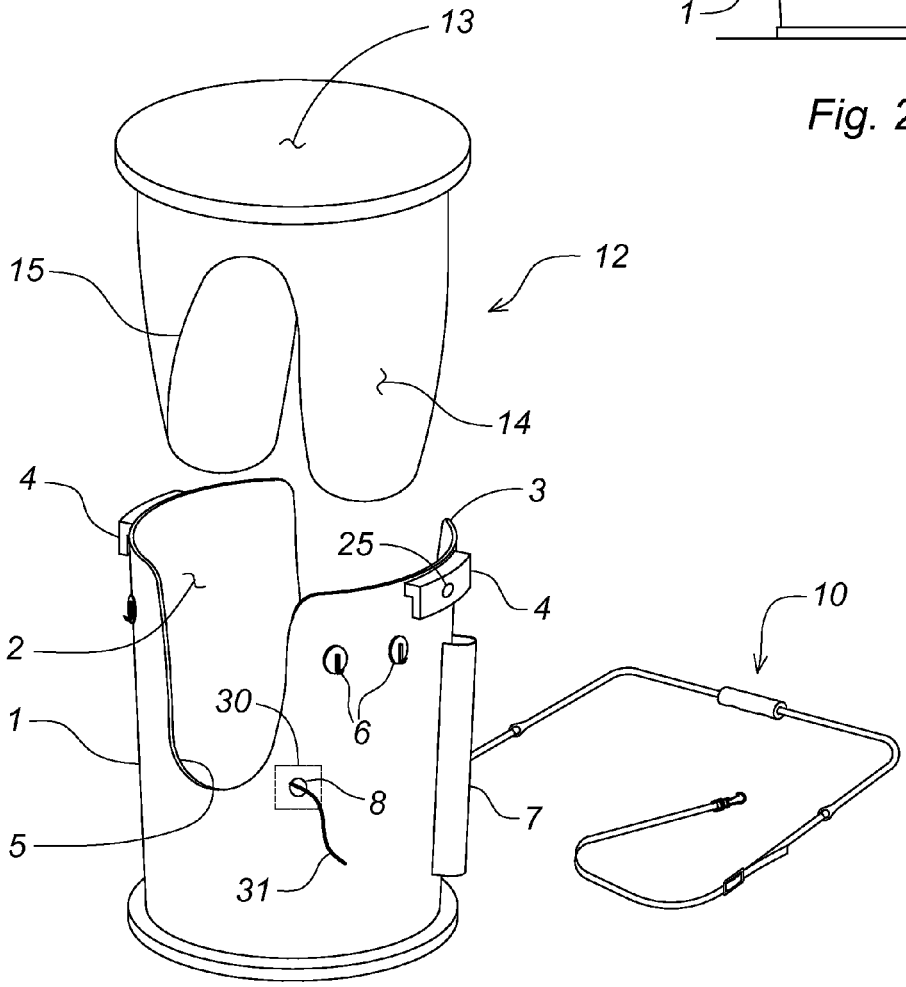
FIG. 1 is a perspective, exploded view of the tool according to the present invention.
Figure 3:
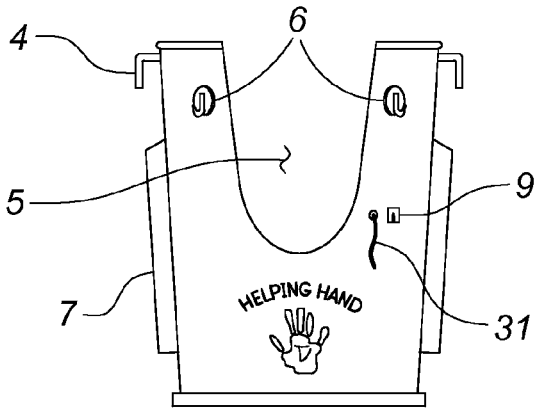
FIG. 3 is a front, isolated view of the base container.
Figure 4:
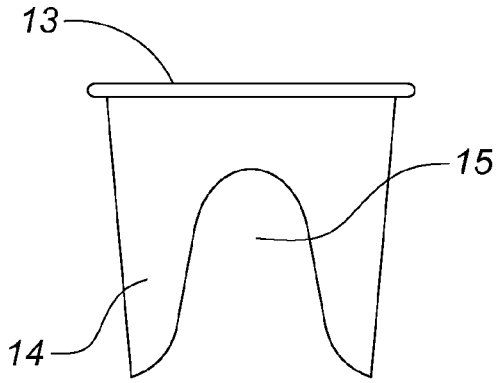
FIG. 4 is a front, isolated view of the compactor.
Figure 5:
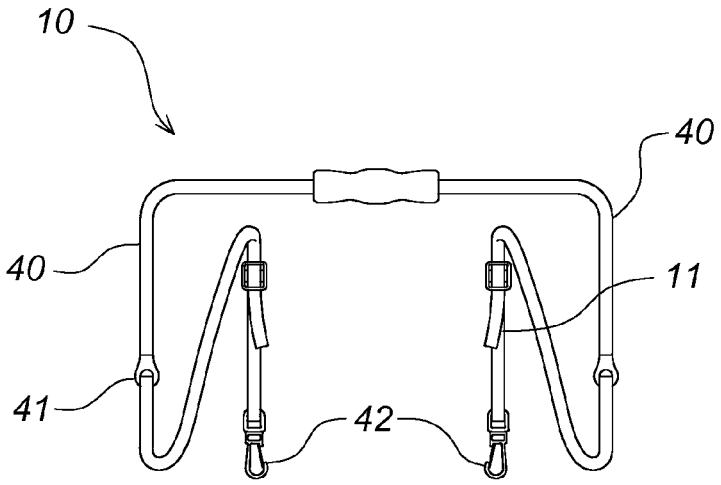
FIG. 5 is an isolated view of the handle and associated straps.

The present invention relates to a tree limb bundling tool comprising a cylindrical base container 1 having a bottom surface, a continuous upstanding outer wall 2 and an open top in communication with an interior chamber. The open top is defined by a circular rim 3 having a pair of opposing handgrips 4 mounted thereon. Each of the handgrips includes an aperture 25 to which a handle 10 is secured, as described in more detail below.

A pair of diametrically-opposed notches 5 extend from the rim to an intermediate portion of the wall. On the exterior surface of the wall are multiple tool hooks 6 and one or more tubular housings 7 for receiving tying items, such as those commonly referred to as "zip ties." Within the interior chamber is a roll 30 of string 31 that exits a grommet 8 on the outer wall. The string may be cut to a desired length with a blade 9 adjacent the grommet.

The device also includes a compactor 12 having a circular upper surface 13 with a cylindrical shroud 14 depending therefrom. The shroud likewise includes a pair of opposing notches 15 extending from an intermediate portion to a lower edge.

The handle 10 is substantially U-shaped having a pair of opposing arms 40 that terminate at an eyelet 41. An adjustable strap 11 secured to each eyelet includes a releasable hook 42 at a distal end for gripping one of the handgrip apertures 25 to attach the handle to the tool. The detachable handle allows the entire tool to be easily transported to and from a work site.

Accordingly, a worker compiles limbs 43 and places them within the notches on the base container. The compactor is inserted into the container with the shroud notches substantially aligned with the base container notches. The worker then either sits or kneels on the upper surface of the compactor at which time a tie or string is wrapped about each end of the compressed limbs allowing them to be quickly and easily discarded.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tree limb bundling tool comprising:

a hollow base container having a bottom surface, at least one outer wall and an open top in communication with an interior chamber;

a first pair of notches formed on said outer wall for receiving a bundle of tree limbs;

a compactor receivable within the interior chamber of said base container, said compactor having an upper surface with a shroud depending therefrom, said shroud having a second pair of notches for aligning with said first pair of notches whereby a worker places the bundle within said first pair of notches, inserts said compactor into said base container with said second pair of notches surrounding the bundle and applies a force to the upper surface of said compactor to compress the bundle for disposal.

2. The tool according to claim 1 wherein said first pair of notches extend from said open top to an intermediate portion of said outer wall.

3. The tool according to claim 2 wherein said second set of notches extend from an intermediate portion of said shroud to a lower edge thereof.

4. The tool according to claim 1 further comprising a housing mounted on the outer wall of said base container, said housing having a tying item received therein.

5. The tool according to claim 1 further comprising a roll of string within the interior chamber of said base container, said string exiting a grommet on the outer wall.

6. The tool according to claim 5 further comprising a blade adjacent said grommet for severing said string.

7. The tool according to claim 1 further comprising at least one tool hook mounted on said outer wall.

8. The tool according to claim 1 further comprising a pair of opposing handgrips on said outer wall.

9. The tool according to claim 8 further comprising:

an aperture on each of said handgrips;

a handle having a pair of ends, each of said ends having a strap securable thereto, said strap having a fastener at a distal end for securing said strap to said aperture.

* * * * *